United States Patent [19]

Gruber et al.

[11] Patent Number: 4,460,672

[45] Date of Patent: Jul. 17, 1984

[54] POSITIVELY CHARGED ELECTROSTATIC TONER CONTAINS LOW MOLECULAR WEIGHT WAXY MATERIAL AND PYRIDINIUM HALIDE OR ORGANIC SULFONATE

[75] Inventors: Robert J. Gruber, Pittsford; Paul C. Julien, Webster; Steven B. Bolte; Ronald J. Koch, both of Rochester, all of N.Y.

[73] Assignee: Xerox Corporation, Stamford, Conn.

[21] Appl. No.: 434,198

[22] Filed: Oct. 14, 1982

[51] Int. Cl.[3] ..... G03G 9/10

[52] U.S. Cl. ..... 430/110; 430/126

[58] Field of Search ..... 430/109, 111, 110, 126

[56] References Cited

U.S. PATENT DOCUMENTS

| | | | |
|---|---|---|---|
| 2,618,551 | 11/1952 | Walkup | 430/121 |
| 3,473,923 | 10/1969 | Ohkubo et al. | 430/107 X |
| 3,510,338 | 5/1970 | Varron | 430/109 X |
| 3,951,835 | 4/1976 | Tomono et al. | 430/110 X |
| 4,100,087 | 7/1978 | Takayama et al. | 430/137 X |

*Primary Examiner*—John D. Welsh

*Attorney, Agent, or Firm*—E. O. Palazzo

[57] ABSTRACT

This invention is generally directed to an improved positively charged dry electrostatic toner composition comprised of resin particles, pigment particles, a low molecular weight waxy material having a molecular weight of from 500 to about 20,000, and from about 0.5 percent to about 10 percent by weight of a charge enhancing additive selected from the group consisting of alkyl pyridinium halides, organic sulfonate compositions and organic sulfate compositions, of the following formulas:

I.

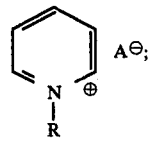

and

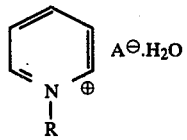

wherein R is a hydrocarbon group containing about 8 to about 22 carbon atoms, and A is an anion, and

II.

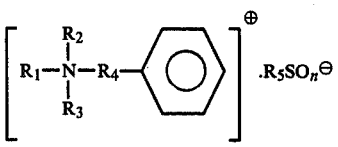

wherein $R_1$ is an alkyl group containing from about 12 carbon atoms to about 22 carbon atoms, $R_2$ and $R_3$ are independently selected from alkyl groups containing from about 1 carbon atom to about 5 carbon atoms, $R_4$ is an alkylene group containing from about 1 carbon atom to about 5 carbon atoms, $R_5$ is a tolyl group or an alkyl group containing from about 1 carbon atom to about 3 carbon atoms, and n is the number 3 or 4.

23 Claims, No Drawings

POSITIVELY CHARGED ELECTROSTATIC TONER CONTAINS LOW MOLECULAR WEIGHT WAXY MATERIAL AND PYRIDINIUM HALIDE OR ORGANIC SULFONATE

BACKGROUND

This invention is generally directed to toner compositions; and developer compositions. More specifically, the present invention is directed to positively charged toner compositions containing a low molecular weight wax, such as polyethylene, and a charge enhancing additive. The toner and developer compositions of the present invention are useful for causing the development of images in electrostatographic imaging systems, particularly those systems wherein an offset preventing liquid, such as a silicone oil is not required.

Developer compositions containing charge enhancing additives, especially additives which impart a positive charge to the tone resin are well-known. Thus, for example, there is described in U.S. Pat. No. 2,986,521, reversal developer compositions comprised of toner resin particles coated with finely divided colloidal silica. According to the disclosure of this patent the developement of electrostatic latent images on negatively charged surfaces is accomplished by applying a developer composition having a positively charged triboelectric relationship with respect to the colloidal silica. Additionally, in U.S. Pat. No. 3,893,935 there is described the utilization of certain quaternary ammonium salts as charge control agents for electrostatic toner compositions. In accordance with the disclosure of this patent, certain quaternary ammonium salts when incorporated into a toner material were found to provide a particular toner composition which exhibited relatively high uniform stable net toner charge when mixed with a suitable carrier vehicle; which toner also exhibited a minimum amount of toner throw off. There is also described in U.S. Pat. No. 4,298,672 positively charged toner compositions containing resin particles, and pigment particles, and as a charge enhancing additive alkyl pyridinium compounds and their hydrates of the formula as detailed in Column 3, beginning at line 14. Examples of alkyl pyridinium compounds disclosed include cetyl pyridinium chloride.

Generally prior art developer compositions are selected for use in developing eletrostatic images, wherein the toner image is fixed to a permanent substrate, such as paper, by contacting the paper with a roller, the surface of which is formed from a material capable of preventing toner particles from sticking thereto. In this process, however, the surface of the fixing roll is brought into contact with the toner image in a hot melt state, thus a part of the toner image can adhere to and remain on the surface of the fixing roll. This causes a part of the toner image to be transferred back onto the surface of a subsequent sheet on which the toner image is to be successively fixed, thereby causing the well-known undesirable offset phenomena.

In order to substantially eliminate offsetting, and more specifically for the purpose of preventing adhesion of the toner particles to the surface of the fixing roller, there has been selected certain types of rollers, the surface of which may be covered with a thin film of an offset preventing liquid such as a silicone oil. These oils are highly effective, however, the apparatus within which they are incorporated is complicated and costly, since for example, a means for feeding the oil is required. Also not only do the silicone oils emit an undesirable odor, these oils deposit on the machine components causing toner particles to collect on, and adhere to the silicone oils, which is highly undesirable. An accumulation of toner particles on machine components is troublesome in that the image quality is affected, and these components must be periodically cleaned and/or replaced, adding to the maintenance costs of the machine system involved.

There thus continues to be a need for positively charged toner and developer compositions, which are useful in electrostatographic imaging systems. More specifically, there is a need for improved positively charged toner compositions, which can be selected for causing the development of electrostatic latent images in electrostatographic devices, wherein offset preventing liquids, such as silicone oils, are not required.

SUMMARY OF THE INVENTION

It is an object of the present invention to provide toner compositions, and developer compositions which overcome the above-noted disadvantages.

In another object of the present invention there is provided positively charged toner compositions which can be used in electrostatographic imaging systems that do not contain silicone oil release fluids.

In yet another object of the present invention, there is provided positively charged toner compositions containing low molecular weight waxes, such as polyethylene and polypropylene, and charge enhancing additives.

It is an additional object of the present invention to provide methods for developing electrostatographic images with positively charged toner compositions containing low molecular weight waxes, and wherein a silicone oil releasing fluid is not needed for preventing toner offset to the fuser rolls.

These and other objects of the present invention are accomplished by providing developer compositions, and positively charged toner compositions, the toner compositions being comprised of resin particles, pigment particles, a low molecular weight wax material, and a charge enhancing additive. More specifically, in one embodiment, the present invention is directed to positively charged toner compositions comprised of resin particles, containing polyester resins, styrene butadiene resins, or styrene butyl methacrylate resins, pigment particles, a low molecular weight waxy composition, such as a low molecular weight polyethylene or polypropylene, and a charge enhancing additive selected from the group consisting of alkyl pyridinium halides, I, organic sulfonate additives and organic sulfate additives, II, of the following formulas:

I.

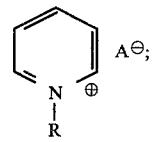

and

-continued

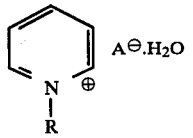

wherein R is a hydrocarbon group containing from about 8 to about 22 carbon atoms, and preferably from 12 to 18 carbon atoms, and A is an anion preferably selected from halides such as chloride, bromide, iodide, sulfate, sulfonate, nitrate, or borate; and

II.

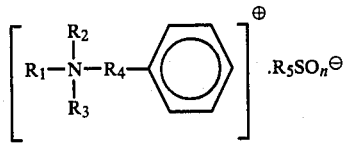

wherein $R_1$ is an alkyl group containing from about 12 carbon atoms to about 22 carbon atoms, and preferably from about 14 carbon atoms to 18 carbon atoms, $R_2$ and $R_3$ are independently selected from alkyl groups containing from about 1 carbon atom to about 5 carbon atoms, $R_4$ is an alkylene group containing from about 1 carbon atom to about 5 carbon atoms, $R_5$ is a tolyl group or an alkyl group containing from about 1 carbon atom to about 3 carbon atoms, and n is the number 3 or 4.

Illustrative examples of hydrocarbon radicals for R, reference formula I include octyl, nonyl, decyl, myristyl, cetyl, oleyl, pentadecyl, heptadecyl, and octadecyl. Specific illustrative examples of alkyl pyridinium compounds include cetyl pryidinium chloride, heptadecyl pyridinium bromide, octadecyl pyridinium chloride, myristyl pyridinium chloride, and the like, as well as the corresponding hydrates, reference for example, U.S. Pat. No. 4,298,672, the disclosure of which is totally incorporated herein by reference.

Illustrative examples of alkyl groups for the compositions embraced by Formula II include methyl, ethyl, propyl, butyl, pentyl, hexyl, octyl, nonyl, decyl, myristyl, cetyl, oleyl, pentadecyl, heptadecyl, stearyl and the like. Preferred alkyl groups for $R_1$ include myristyl, stearyl, and cetyl, while preferred alkyl groups for $R_2$, $R_3$ and $R_5$ include methyl, ethyl, and propyl, with the preferred alkylene groups for $R_4$ being methylene and ethylene. Examples of other alkylene groups include propylene, butylene, and the like.

Specific illustrative examples of organic sulfonate and sulfate compositions embraced within Formula II thus include stearyl benzyl ammonium, para-toluene sulfonate, stearyl dimethyl phenethyl ammonium methyl sulfonate, stearyl dimethyl phenethyl ammonium para-toluene sulfonate, cetyl diethyl benzyl ammonium methyl sulfate, myristyl dimethyl phenethyl ammonium para-toluene sulfonate, cetyl diethyl benzyl ammonium methylsulfate, and the like, reference for example, the disclosure contained in U.S. Pat. No. 4,338,390, the disclosure of which is totally incorporated herein by reference.

Illustrative examples of resins useful in the toner compositions of the present invention includes numerous known suitable resins such polyesters, styrene/butadiene resins, styrene/methacrylate resins, polyamides, epoxies, polyurethanes, vinyl resins and polymeric esterification products of a dicarboxylic acid and a diol comprising a diphenol. Suitable vinyl resins include homopolymers or copolymers of two or more vinyl monomers. Typical examples of vinyl monomeric units include: styrene, p-chlorostyrene vinyl naphthalene, vinyl chloride, vinyl bromide, vinyl fluoride, ethylenically unsaturated monoolefins such as ethylene, propylene, butylene, isobutylene and the like; vinyl esters such as vinyl acetate, vinyl propionate, vinyl benzoate, vinyl butyrate and the like; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketone, vinyl hexyl ketone, methyl isopropenyl ketone and the like; vinylidene halides such as vinylidene chloride, vinylidene chlorofluoride and the like; and N-vinyl indole, N-vinyl pyrrolidene and the like; and mixtures thereof.

The preferred toner resins of the present invention are selected from polystyrene methacrylate resins, polyester resins such as those described in U.S. Pat. No. 3,655,374, the disclosure of which is totally incorporated herein by reference, polyester resins resulting from the condensation of dimethylterephthalate, 1,3 butanediol, and pentaethythriol, and Pliolite resins which are commercially available from Goodyear Corporation as S5A. The Pliolite resins are believed to be copolymer resins of styrene and butadiene, wherein the styrene is present in an amount of from about 80 weight percent to about 95 weight percent, and the butadiene is present in an amount of from about 5 weight percent to about 20 weight percent. A specific styrene butadiene resin found highly useful in the present invention is comprised of about 89 percent of styrene, and 11 percent of butadiene.

Various suitable colorants and/or pigment particles may be incorporated into the toner particles, such materials being well known and including, for example, carbon black, Nigrosine dye, magnetic particles such as Mapico Black, which contains a mixture of iron oxides, and the like. The pigment particles are present in the toner in sufficient quantities so as to render it highly colored in order that it will form a visible image on the recording member. Thus, for example, the pigment particles, with the exception of magnetic materials, should be present in the toner composition in an amount of from about 2 percent by weight to about 15 percent by weight, and preferably from about 2 percent by weight to about 10 percent by weight. With regard to magnetic pigments such as Mapico Black, they are generally incorporated into the toner composition in an amount of from about 10 percent by weight to about 60 percent by weight, and preferably from about 20 percent by weight to about 30 percent by weight.

While the magnetic particles can be present in the toner composition as the only pigment, these particles may be combined with other pigments, such as carbon black. Thus, for example, in this embodiment of the present invention, the other pigments including carbon black are present in an amount of from about 5 percent by weight to about 10 percent by weight, with the magnetic pigment being present in an amount of from about 10 to about 60 percent by weight. Other percentage combinations of other pigments, and magnetic pigments, may be selected provided the objectives of the present invention are achieved.

The low molecular weight waxy material incorporated into the toner composition generally has a molecular weight of from between about 500 and about 20,000, and preferably is of a molecular weight of from about 1,000 to about 5,000. Illustrative examples of low molecular weight waxy materials included within the scope of the present invention are polyethylenes commercially available from Allied Chemical and Petrolite Corporation, Epolene N-15, commercially available from Eastman Chemical Products Incorporation, Viscol 550-P, a low molecular weight polypropylene available from Sanyo Kasei K.K. and similar materials. The commercially available polyethylenes selected have a molecular weight of about 1,000 to 1,500 while the commercially available polypropylenes incorporated into the toner compositions of the present invention have a molecular weight of about 4,000. Many of the polyethylene and polypropylene compositions useful in the present invention are illustrated in British Pat. No. 1,442,835.

The low molecular weight wax materials, such as low molecular weight polyethylenes and polypropylenes can be incorporated into the toner compositions in various amounts, however, generally these waxes are present in the toner composition in an amount of from about 1 percent by weight to about 10 percent by weight, and preferably in an amount of from about 2 percent by weight to about 5 percent by weight.

The charge enhancing additives are mixed into the developer composition so as to be present in an amount of from about 0.5 percent to about 10 percent by weight, and preferably from about 1 percent by weight to about 5 percent by weight, based on the total weight of the toner particles. The charge control additives can either be blended into the developer mixture or coated onto the pigment particles such as carbon black. The preferred charge enhancing additives incorporated into the toner compositions of the present invention include cetyl pyridium chloride, and stearyl dimethyl phenethyl ammonium para-toluene sulfonate.

The toner resin is present in an amount to provide a toner composition which will result in a total of about 100 percent for all components. Accordingly, for non-magnetic toner compositions the toner resin is generally present in an amount of from about 60 percent by weight to about 90 percent by weight, and preferably from about 80 percent by weight to about 85 percent by weight. In one embodiment, thus, the toner composition can be comprised of 90 percent by weight of resin particles, 5 percent by weight of pigment particles, such as carbon black, 3 percent by weight of the charge enhancing additive material, and 2 percent by weight of the low molecular weight wax.

Many known methods may be used for preparing the toner compositions of the present invention, one method involving melt blending the resin particles, the pigment particles, the charge enhancing additive, and the low molecular weight wax, followed by mechanical attrition. Other methods include those well known in the art such as spray drying, melt dispersion and dispersion polymerization. For example, a solvent dispersion of resin particles, pigment particles, charge enhancing additive, and low molecular weight wax are spray dried under controlled conditions, thereby resulting in the desired toner composition. A toner prepared in this manner results in a positively charged toner composition in relation to the carrier materials, and these toners exhibit the improved properties as mentioned herein.

Illustrative examples of various carrier materials selected for incorporation into the developer composition include those materials that are capable of triboelectrically obtaining a charge of opposite polarity to that of the toner particles including, for example, glass, steel, nickel, iron ferrites, silicone dioxide, and the like. These carriers can be used with or without a coating, examples of coatings being fluoropolymers, including polyvinylidene fluoride commercially available from E. I. duPont Co. Additionally, there can be selected nickel berry carriers as described in U.S. Pat. Nos. 3,847,604 and 3,767,598, which carries are nodular carrier beads of nickel characterized by surfaces of reoccurring recesses and protrusions, thus providing particles with a relative large external area. The diameter of the coated carrier particles ranges from about 50 microns to about 1,000 microns, thus allowing the carrier particles to possess sufficient density and inertia to avoid adherance to the electrostatic images during the development process.

The carrier particles are mixed with the toner composition invarious suitable combinations, however, best results are obtained with from about 1 part by weight of toner particles to about 3 parts by weight of toner particles, to about 100 parts to 200 parts by weight of carrier particles.

The toner and developer compositions of the present invention are very useful for developing electrostatic latent images, particularly those contained on an imaging member charged negatively. When employing the developing compositions of the present invention, it is not necessary to utilize a release fluid, such as a silicone oil to prevent toner offset, since the compositions of the present invention prevent toner offset without such a toner release fluid. Additionally, as indicated hereinbefore, the toner compositions of the present invention are charged positively, in view of the presence of the charge enhancing additive.

Examples of imaging surfaces that may be selected include various known photoreceptor compositions, particularly those which are negatively charged, which usually occurs with organic photoreceptors including layered photoreceptor materials. Illustrative examples of layered photoresponsive materials include those containing a substrate, a generating layer, and a transport layer, as disclosed in U.S. Pat. No. 4,265,990, the disclosure of which is totally incorporated herein by reference. Examples of generating layers include trigonal selenium, metal phthalocyanines, metal free phthalocyanines, and vanadyl phthalocyanine, while examples of transport materials include various diamines dispersed in resinous binders. Other organic photoresponsive materials that may be utilized in the practice of the present invention include polyvinyl carbazole, 4-dimethylaminobenzylidene, benzhydrazide; 2-benzylideneaminocarbazole, (2-nitro-benzylidene)-p-bromoaniline; 2,4-diphenylquinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; and mixtures thereof.

The imaging method of the present invention thus involves the formation of a negatively charged electrostatic latent image on a suitable imaging member, contacting the image with the developer composition of the present invention comprised of toner particles and carrier particles, wherein the toner particles contain resin particles, pigment particles, a charge enhancing additive and a low molecular weight wax, followed by transferring the developed image to a suitable substrate such as paper, and permanently affixing the image thereto by various suitable means such as heat.

The following examples are being supplied to further define specific embodiments of the present invention, it being noted that these examples are intended to illustrate and not limit the scope of the present invention. Parts and percentages are by weight unless otherwise indicated.

EXAMPLE I

There was prepared by melt blending in a Banbury mixing device, maintained at 120° C., followed by mechanical attrition, a toner composition containing 86 percent by weight of a polyester resulting from the condensation of dimethylterephthalate, 1,3-butane diol and pentaethythritol, 2 percent by weight of the low molecular weight wax polypropylene commercially available as Viscol 550-P from Sanyo Corporation, 2 percent by weight of cetyl pyridinium chloride, and 10 percent by weight of Regal 330 carbon black.

There was also prepared by melt blending in a Banbury mixing device, maintained at 120° C., followed by mechanical attrition, a toner composition containing 86 percent by weight of a Pliolite resin, commercially available from Goodyear Chemical Corporation, which resin contained 89 percent by weight of styrene, and 11 percent by weight of butadiene, 2 percent by weight of the low molecular weight wax polypropylene commercially available as Viscol 550-P from Sanyo Corporation, 2 percent by weight of cetyl pyridinium chloride, and 10 percent by weight of Regal 330 carbon black.

The triboelectric charge contained on the above-prepared toner particles was then determined after mixing these two toner compositions, 1 part by weight with 100 parts by weight of carrier particles consisting of a steel core coated with 1.25 percent by weight of a copolymer of trifluoroethylene, and vinyl chloride (FPC 461), by examining the charge level on a toner charge spectrograph. This known instrument disperses toner particles in proportion to the charge to diameter ratio, and with the aid of automated microscopy can generate charge distribution histograms for selected toner size classes. The toner composition containing the polyester resin had a triboelectric charge of 0.96 femtocoulombs per micron, while the toner composition containing the Pliolite resin had a triboelectric charge of 1.2 femtocoulombs per micron.

Uncharged toner particles containing 88 percent by weight of the polyester resin resulting from the condensation of dimethylterephthalate, 1,3-butane diol and pentaethythritol, 10 percent by weight of carbon black, and 2 percent by weight of the polypropylene wax, 550-P, had an admixed charging rate of greater than 8 minutes as measured on a toner charge spectrograph. In contrast, the toner composition of the present invention comprised of a polyester resin resulting from the condensation of dimethylterephthalate, 1,3-butane diol and pentaethythritol, 8 percent by weight of carbon black, and 2 percent by weight of the polypropylene wax, 550-P, and 2 percent by weight of cetyl pyridinium chloride, the admix charging rate was less than about 15 seconds as measured on a toner charge spectrograph, and the toner particles acquired a charge of 1 femtocoulomb per micron. Use of the charge spectrograph allows the monitoring of admix toner charging rates. The charge distribution time sequences can thus be used to distinguish between slow and rapid admix charging rates.

The following toner compositions were then prepared by repeating the method of Example I, and the resulting compositions were compared for various properties with toner compositions containing no waxy material, with the following results:

TABLE I

| TONER POLYMER RESIN | CHARGE ENHANCING ADDITIVE | LOW MOLECULAR WEIGHT WAX | MINIMUM FIX TEMP MFT[1] FUSING TEMP °F. | FUSING[2] LATITUDE °F. | RELEASE[3] CHARACTERISTICS |
|---|---|---|---|---|---|
| I. Styrene/n-butylmethacrylate (58/42) 89.7%, 10.3% carbon black | cetyl pyridinium chloride, 2% by weight | none | 320 | 0 | very poor |
| II. Polyester[4] 88% by weight, 10% by weight carbon black | cetyl pyridium chloride, 2% by weight | none | 275 | 0 | very poor |
| III. Polyester[4] 88% by weight, 10% by weight carbon black | cetyl pyridinium chloride, 2% by weight | Polypropylene 550-P, 2% by weight | 275 | 125 | excellent |
| IV. Polyester[4] 88% by weight, 10% by weight carbon black | cetyl pyridinium chloride, 2% by weight | Barceo wax 1,000, 2% by weight | 275 | 125 | excellent |
| V. Pliolite[5] 90% by weight, 10% by weight carbon black | cetyl pyridinium chloride, 2% by weight | none | 300 | 0 | very poor |
| VI. Pliolite[5] 86% by weight, 10% by weight carbon black | cetyl pyridinium chloride, 2% by weight | Polypropylene 500-P, 2% by weight | 300 | 100 | excellent |

TABLE I-continued

| TONER POLYMER RESIN | CHARGE ENHANCING ADDITIVE | LOW MOLECULAR WEIGHT WAX | MINIMUM FIX TEMP MFT[1] FUSING TEMP °F. | FUSING[2] LATITUDE °F. | RELEASE[3] CHARACTERISTICS |
|---|---|---|---|---|---|
| VII. Poly(styrene-co-n-butylmethacrylate)[5] 86% by weight, 10% by weight carbon black | cetyl pyridinium chloride 2% by weight | Polypropylene 550P, 3% by weight | 320 | 75 | very good |

[1]The designation MFT represents the minimum temperature required to produce an acceptable toner fix to paper.
[2]The difference between the MFT, the minimum fix temperature and the temperature at which toner begins to stick to the fuser roll is the fusing latitude. An acceptable fusing latitude would be about 50° F. The fusing experiments were performed in the Xerox 9200 Copier fuser assembly. The fuser assembly did not contain silicone oil.
[3]By very poor release characteristics is meant that the toner offsets and transfers to the fuser roll, which toner will eventually deposit on paper containing the electrostatic latent image. Additionally, in some instances, toner deposits on the fuser roll will cause paper to stick to the roll. In contrast, excellent release characteristics result in substantially no toner being deposited on the fuser roll of the 9200 fuser assembly. Additionally, excellent release characteristics are characterized by toners have a fusing latitude of greater than 50° F. with very little, if any toner accumulation occurrring on the 9200 fuser assembly after extended copy throughput, over 10,000 copy cycles.
[4]The polyester specified resulted from the condensation reaction of dimethylterephthalate, 1,3 butanediol, and pentaethythritol.
[5]The Pliolite resins were commercially obtained from Goodyear and are known as Goodyear S5A, styrene butadiene copolymer resins.

Developer compositions were prepared by mixing 1 part by weight of the toner compositions designated III, IV, VI, and VII in Table I, which toner compositions were comprised of the polymer, charge enhancing additive and low molecular weight wax in the proportions listed with 100 parts by weight of a carrier material consisting of a ferrite core coated with 0.8 percent by weight of a polychlorotrifluoroethylene-co-vinylchloride copolymer commercially available from Hooker Chemical Corporation as FPC 461.

Each of these developer compositions were then utilized in a xerographic imaging system wherein the photoreceptor is comprised of a trigonal selenium generating layer, in contact with an amine transport layer of N,N'-diphenyl-N'-bis(3-methylphenyl)-[1,1'-biphenyl]4,4 diamine dispersed in a polycarbonate resinous binder, which photoreceptor is prepared as disclosed in U.S. Pat. No. 4,265,990 and is charged negatively. There is immediately obtained after one imaging cycle, images of high quality and excellent resolution. Although the xerographic imaging system employed contained no silicone fuser release oil, excellent fusing of the toner particles is observed since no smearing or smudging of the images resulted and no offsetting was observed after 10,000 imaging cycles with each of the developer compositions.

Other modifications of the present invention will occur to those skilled in the art based upon a reading of the present disclosure. These are intended to be included within the scope of this invention.

We claim:

1. An improved positively charged dry electrostatic toner composition useful in imaging systems containing no silicone oil release fluids and wherein their results no offsetting of the resulting images consisting of a single phase toner resin particles selected from the group consisting of polymers of styrene methacrylates, styrene acrylates, polyesters, and styrene butadienes, pigment particles, a low molecular weight waxy material having a molecular weight of from 500 to about 20,000, and from about 0.5 percent to about 10 percent by weight of a charge enhancing additive selected from the group consisting of alkyl pyridinium halides, organic sulfonate compositions and organic sulfate compositions, of the following formulas:

I.

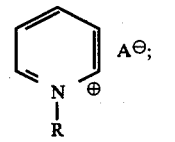

and

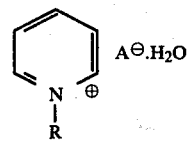

wherein R is a hydrocarbon group containing from about 8 to about 22 carbon atoms, and A is an anion, and

II.

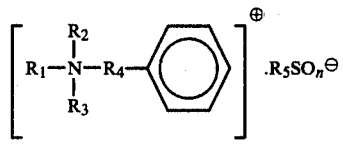

wherein $R_1$ is an alkyl group containing from about 12 carbon atoms to about 22 carbon atoms, $R_2$ and $R_3$ are independently selected from alkyl groups containing from about 1 carbon atom to about 5 carbon atoms, $R_4$ is an alkylene group containing from about 1 carbon atom to about 5 carbon atoms, $R_5$ is a tolyl group or an alkyl group containing from about 1 carbon atom to about 3 carbon atoms, and n is the number 3 or 4.

2. A toner composition in accordance with claim 1 wherein the resin particles are selected from, styrene butadiene coplymers, or styrene methacrylate copolymers.

3. A toner composition in accordance with claim 1 wherein the polyester results from the condensation reaction of dimethylterephthalate, 1,3-butanediol, and pentaethythritol.

4. A toner composition in accordance with claim 1 wherein the styrene butadiene copolymer contains 89 percent by weight of styrene, and 11 percent by weight of butadiene.

5. A toner composition in accordance with claim 1 wherein the waxy material is selected from the group consisting of polyethylene and polypropylene.

6. A toner composition composition in accordance with claim 5 wherein the polyethylene or polypropylene are present in an amount of from about 1 percent by weight to about 10 percent by weight.

7. A toner composition composition in accordance with claim 1 wherein the charge enhancing additive cetyl pyridinium chloride.

8. A toner composition composition in accordance with claim 1 wherein the charge enhancing additive is stearyl dimethyl phenethyl ammonium para-toluene sulfonate.

9. A toner composition in accordance with claim 1 further including carrier particles.

10. A toner composition in accordance with claim 9 wherein the carrier particles consist of a steel core coated with a polychlorotrifluoroethylene-co-vinylchloride copolymer.

11. A method for developing latent images which comprises forming an electrostatic latent image on a negatively charged imaging member, contacting the image with the toner composition of claim 1, followed by transferring the image to a suitable substrate, and optionally permanently affixing the image thereto wherein the method is accomplished in the absence of a silicone oil release fluid, and there results no offsetting of the resulting images.

12. A method of imaging in accordance with claim 11 wherein the resin particles are comprised of a polyester resulting from the condensation reaction of dimethyl terephthalate, 1,3 butanediol, and pentaethythritol.

13. A method of imaging in accordance with claim 11 wherein the wax is selected from polypropylene, polyethylene, or mixtures thereof.

14. A toner composition in accordance with claim 1 wherein R is an alkyl group containing from about 12 carbon atoms to about 22 carbon atoms, $R_1$ is an alkyl group containing from about 14 carbon atoms to about 18 carbon atoms, and n is the number 3.

15. A toner composition in accordance with claim 1 wherein R is an alkyl group containing from about 12 carbon atoms to about 18 carbon atoms, and $R_1$ is an alkyl group containing from about 14 carbon atoms to about 18 carbon atoms, and n is the number 4.

16. A toner composition in accordance with claim 1 wherein $R_2$ and $R_3$ are methyl groups.

17. A toner composition in accordance with claim 1 wherein $R_4$ is a methylene group.

18. A toner composition in accordance with claim 1 wherein the waxy material is a mixture of polyethylene and polypropylene.

19. A toner composition in accordance with claim 5 wherein the molecular weight of the polyethylene or polypropylene is from about 1,000 to about 5,000.

20. A method of imaging in accordance with claim 13 wherein the molecular weight of the polyethylene or polypropylene is from about 1,000 to about 5,000.

21. A toner composition in accordance with claim 1 wherein the pigment particles are carbon black.

22. A toner composition in accordance with claim 2 wherein the polyester is present in an amount of about 88% by weight, and results from the condensation of dimethyl terephthalate, 1,3 butanediol, and pentaethythritol, the charge enhancing additive is cetyl pyridinium chloride present in an amount of about 2% by weight, the pigment particles are carbon black, present in an amount of 10% by weight, and the low molecular wax is polypropylene, present in the amount of 2% by weight.

23. A toner composition in accordance with claim 2 wherein the styrene butadiene polymer is present in an amount of 86% by weight, and contains 89% by weight of styrene and 11% by weight of butadiene, the pigment particles are carbon black present in an amount of 10% by weight, the charge enhancing additives is cetyl pyridinium chloride, present in an amount of about 2% by weight, and the low molecular weight wax is polypropylene, present in the amount of 2% by weight.

* * * * *